US005603292A

United States Patent [19]

Håkansson

[11] Patent Number: 5,603,292

[45] Date of Patent: Feb. 18, 1997

[54] VALVE MECHANISM FOR AN INTERNAL COMBUSTION ENGINE

[75] Inventor: Nils-Olof Håkansson, Stenkullen, Sweden

[73] Assignee: AB Volvo, Stenkullen, Sweden

[21] Appl. No.: 569,157

[22] PCT Filed: Jun. 21, 1994

[86] PCT No.: PCT/SE94/00616

§ 371 Date: Dec. 22, 1995

§ 102(e) Date: Dec. 22, 1995

[87] PCT Pub. No.: WO95/00751

PCT Pub. Date: Jan. 5, 1995

[30] Foreign Application Priority Data

Jun. 22, 1993 [SE] Sweden ..... 9302159

[51] Int. Cl.[6] ..... F01L 13/00; F02M 25/07

[52] U.S. Cl. ..... 123/90.16; 123/90.39; 123/568

[58] Field of Search ..... 123/90.15, 90.16, 123/90.39, 90.44, 568

[56] References Cited

U.S. PATENT DOCUMENTS

| | | | |
|---|---|---|---|
| 1,952,881 | 3/1934 | Minter | 123/568 |
| 4,357,917 | 11/1982 | Aoyama | 123/568 |
| 4,424,790 | 1/1984 | Curtil | 123/559 |
| 4,700,684 | 10/1987 | Pischinger et al. | 123/568 |
| 4,722,315 | 2/1988 | Pickel | 123/568 |
| 5,203,830 | 4/1993 | Faletti et al. | 123/568 |
| 5,303,686 | 4/1994 | Kanesaka | 123/568 |
| 5,421,308 | 6/1995 | Hitomi et al. | 123/90.15 |

*Primary Examiner*—Weilun Lo
*Attorney, Agent, or Firm*—Young & Thompson

[57] ABSTRACT

Valve mechanism in an internal combustion engine, comprising at least one intake valve and at least one exhaust valve in each cylinder. For each cylinder there are at least two rocker arms journalled on a rocker arm shaft for operating a respective one of the valves. A transmission (15,17,18) selectively moves the exhaust valve (5) from a closed position toward an open position during the engine intake stroke to draw exhaust into the cylinder (30) during the intake stroke.

9 Claims, 4 Drawing Sheets

VALVE MECHANISM FOR AN INTERNAL COMBUSTION ENGINE

Figure 1:
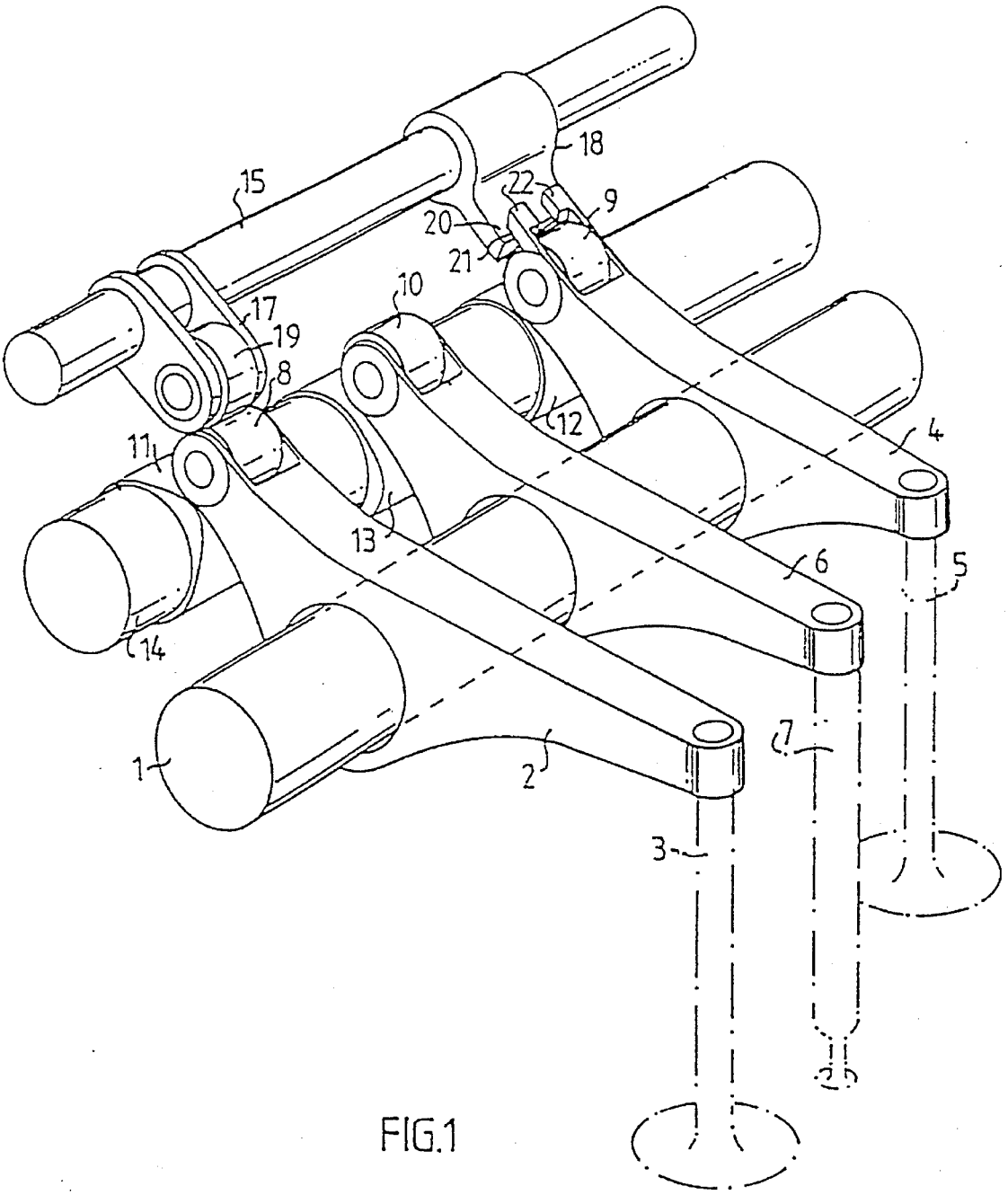

The present invention relates to a valve mechanism in an internal combustion engine, comprising at least one intake valve and at least one exhaust valve in each cylinder and, for each cylinder, at least two rocker arms journalled on a rocker arm shaft for operating the valves.

There are great potential gains to be achieved by reducing the harmful substances in diesel exhaust by recirculation of exhaust, without adversely affecting engine efficiency or soot level as much as with other methods.

Recycling exhaust which has first been cooled is an effective step, especially at high load, but the required cooling power will be quite high and a cooling device will be required which can provide half the cooling power of the engine intercooler. Since the exhaust is polluted and hot, there will, however, be practical problems with such a system. Returning exhaust without cooling has positive effects primarily when engine load is low but not quite as positive when the engine load is high.

Conventional systems for exhaust return comprise shutter and valve devices in the exhaust and intake systems. When using such systems in turbo-charged engines, there will, however, be problems due to the fact that the pressure is higher on the intake side than on the exhaust side. Thus, some form of pump device is needed to get the exhaust to the pressure side of the turbo compressor. Alternatively, one could lead the exhaust to the suction side of the turbo compressor prior to the intercooler, but this is not practical, since hot dirty exhaust would soon destroy the intercooler.

The purpose of the present invention is, starting from a conventional valve mechanism of the type described by way of introduction, to achieve an arrangement, by means of which exhaust can be returned to the intake air without requiring an extra shutter and valve system on the exhaust and intake side.

This is achieved according to the invention by means of a valve mechanism which has transmission means which are arranged to selectively open the exhaust valve during the engine intake stroke to draw exhaust into the cylinder during the intake stroke.

Such an arrangement avoids condicting the exhaust to the intake side and eliminates problems with soiling and deposits. The invention utilizes the fact that, even in a supercharged engine, the pressure in the cylinder after the initial intake stroke during the intake cycle, is lower than the exhaust pressure, due to the pressure drop over the intake valve. This eliminates the need for an extra pumping device for exhaust return.

According to a preferred embodiment of the valve mechanism according to the invention, the transmission means comprise a second shaft rotatably journalled parallel to the rocker arm shaft and having first and second pivot arms, non-rotatably joined to said shaft, the first of which interacts with the intake rocker arm to convert its rocking motion to a rotary movement of the second shaft, and the second of which interacts with the exhaust rocker aim to convert the rotary movement of the second shaft into a rocking movement of the exhaust rocker arm. One of said surfaces is made as a cam surface, so that the lifting of the exhaust valve during the intake stroke is variable from no lift at all in a predetermined axial position of the second shaft to maximum lift after a certain displacement of the second shaft from said predetermined position.

By varying the length of the open time for the exhaust valve during the intake stroke it is possible to regulate the mount of recirculated exhaust and determine the percentage of exhaust in the Combustion air. Since the opening of the exhaust valve is effected individually in each cylinder and can be rapidly controlled, the mixing-in of exhaust will be well defined and can be varied as a function of engine work load or rpm for example. It is not affected by residual gases in the intake manifold for example as in conventional systems. Each axial position of the second shaft and thus of the second pivot arm will thus define a given lifting height and time period of the exhaust valve during the intake stroke.

Figure 2:
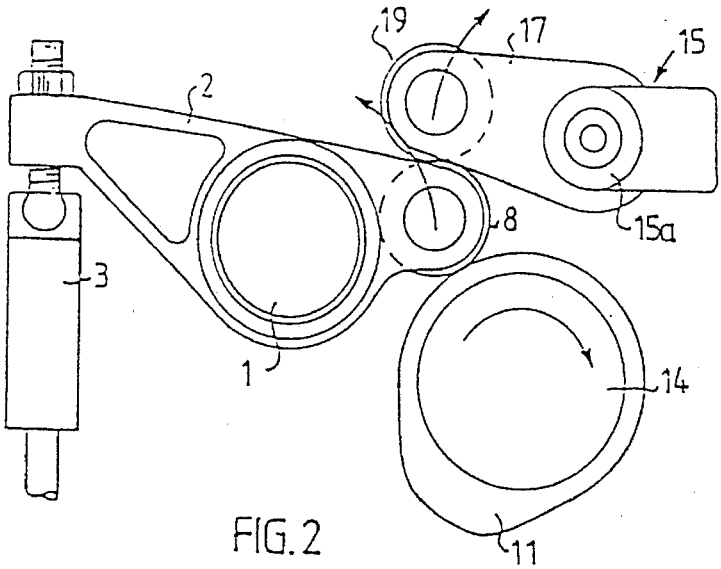
Figure 3:
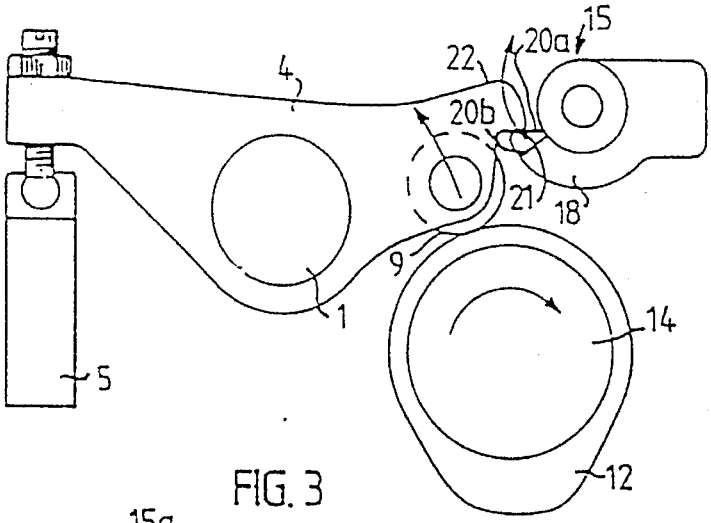
Figure 4:
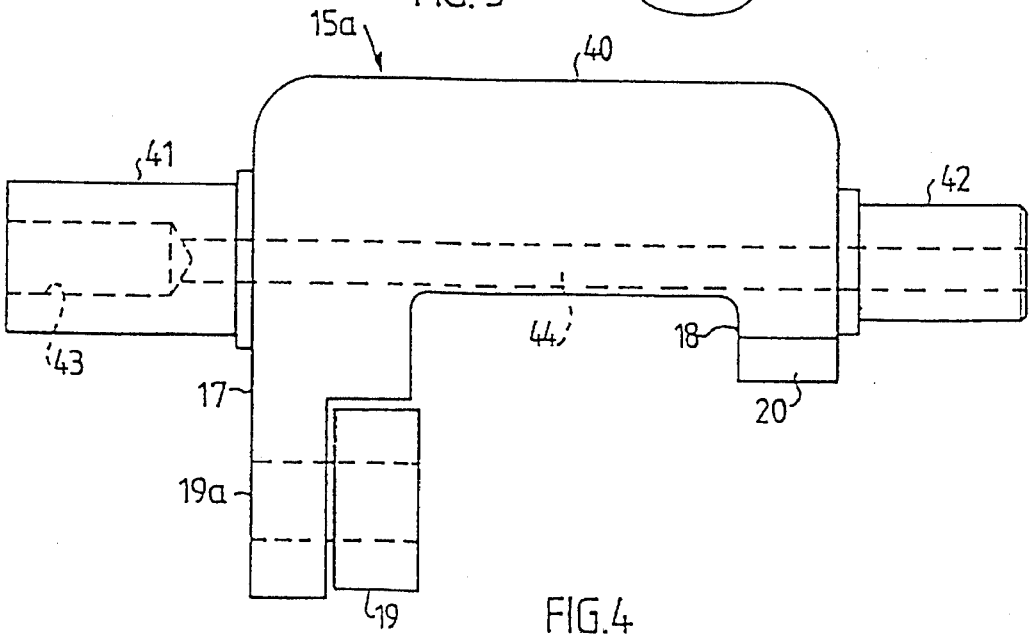
Figure 5:
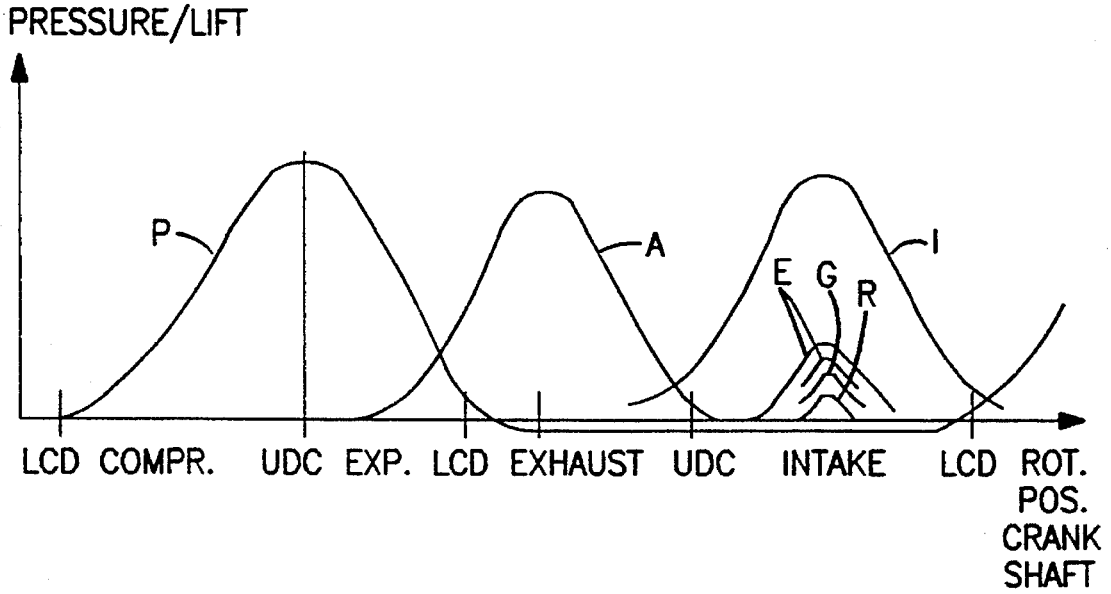
Figure 6:
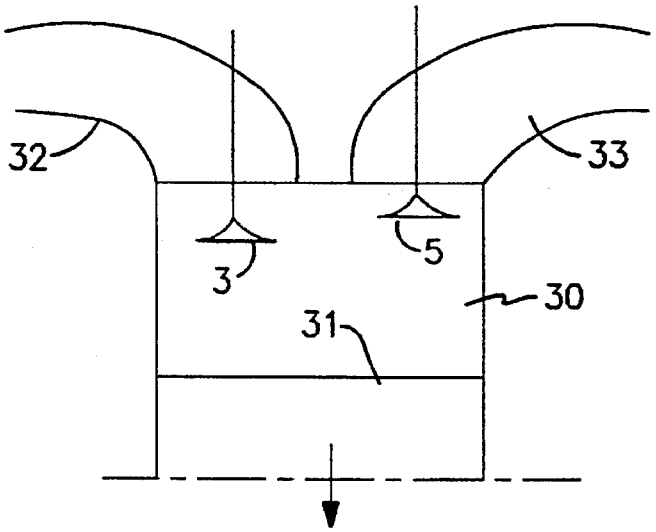
Figure 7:
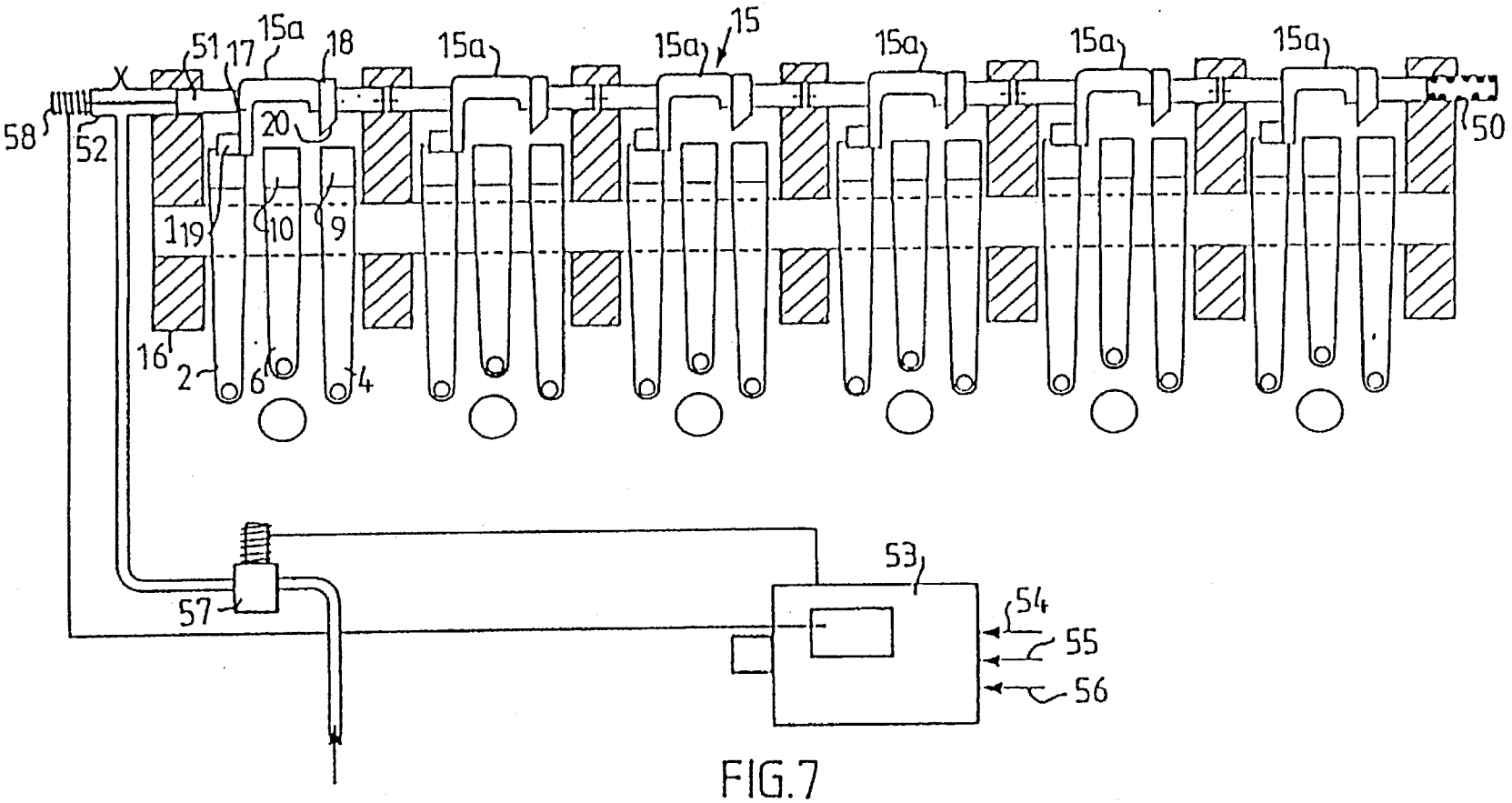

The invention will be described in more detail with reference to examples shown in the accompanying drawings, where FIG. 1 is a schematic perspective view of one embodiment of a valve mechanism according to the invention, FIG. 2 is a side view of an intake rocker arm with associated drive means, FIG. 3 is a side view of an exhaust rocker arm with associated drive means, FIG. 4 is a plan view of a detail in FIGS. 2 and 3, FIG. 5 is a pressure and valve lift diagram, FIG. 6 is a schematical longitudinal section of a cylinder chamber with piston and valves, and FIG. 7 is a schematic plan view of a valve mechanism for a six cylinder engine with a schematically represented control system.

In FIG. 1, the numeral 1 designates a rocker arm shaft, on which there are journalled a rocker arm 2 for an intake valve 3 and a rocker arm 4 for an exhaust valve 5. Furthermore, a rocker arm 6 for a so-called unit injector 7 is journalled on the rocker arm shaft 1.

Each rocker arm 2, 4 and 5 has an individual cam roller 8, 9 and 10, respectively, following; cams 11, 12 and 13, respectively, on the cam shaft 14.

According to the invention, a second 15 is rotatably journalled parallel to the rocker arm shaft 1 in bearings 16 (see FIG. 7). The shaft 15 is also axially displaceably mounted, as will be described in more detail below with reference to FIG. 7. A first pivot arm 17 and a second pivot arm 18 are fixed to the shaft 15. The pivot arm 17 has a rotatably journalled roller 19 which is in contact with the cam roller 8 of the intake rocker arm 2. The roller 19 is narrower than the roller 8 so that it can be displaced axially while retaining contact with the roller 8 when the shaft 15 is displaced axially. With the arrangement described above, the rocking movement of the intake rocker arm 2 is converted into a reciprocating rotary movement of the shaft 15. The second pivot arm 18 has an inclined cam surface 20, the highest and lowest points thereof are illustrated by the lines **20*a* and 20*b*, respectively in FIG. 3. The cam surface 20 faces an opposing surface 21 on a pair of fingers 22 (can be a single component) at one end of the exhaust rocker arm 4. Depending on the axial setting of the shaft 15, the rocker arm 18, upon rotation of the shaft 15 will rock the exhaust rocker arm 4 and lift the exhaust valve 5 from its seat when the cam surface 20 makes contact with the surface 21 on the exhaust rocker arm 4**.

In an axial limit position of the shaft 15, there will be no contact between the cam surface 20 and the surface 21 of the exhaust rocker arm 4, and this means that the exhaust valve 5 will remain completely closed during the intake stroke. In the other limit position, an outer portion of the surface 21 will be in contact with the highest point **20*a* of the cam surface 20, meaning that the exhaust valve 5 will be opened maximally during the intake stroke. In a practical embodiment in an engine in which the maximum lift of the exhaust valve during the exhaust stroke is approximately 13 mm, the maximum lift in the intake stroke can be about 4 mm. In the diagram in FIG. 6, the curve P illustrates the pressure in the cylinder during compression and expansion. The curve A illustrates the lifting movement of the exhaust valve 5 during the exhaust stroke and the curve 5 illustrates the lifting movement of the intake valve 3 during the intake stroke. The lifting movement of the exhaust valve 5 during the intake stroke is illustrated by the curves EGR, where the uppermost curve illustrates the maximum lift and the underlying curves randomly chosen lower valve Lifts. In practice, the control of the exhaust return is continuously variable between zero exhaust valve lift and maximum exhaust valve lift. As is also evident from the diagram, the exhaust and intake valves 5 and 3**, respectively, are synchronized during the intake stroke, so that the maximum lift height is reached simultaneously.

FIG. 6 illustrates schematically a cylinder 30, the piston 31 of which lies midway between upper and lower dead centres during the intake stroke. The intake valve 3 and the exhaust valve 5 are lifted maximally. When there is a charge pressure in the intake valve 32 of circa 1.6 bar there will be an exhaust pressure in the exhaust manifold 33 of circa 1.4 bar. The pressure drop over the intake valve 3 due to the throttling effect will result in pressure in the cylinder 30 of about 1 bar, which will mean that exhaust will be drawn into the cylinder at the same time as the intake air.

The valve mechanism according to the invention has been described in the preceding structurally and functionally with reference to a single cylinder. A multi-cylinder engine has interconnected transmission means corresponding to the number of cylinders which arc of the type described, as is illustrated schematically in FIG. 7 for a six-cylinder engine. The shaft 15 in this case consists of six shaft components 15*a* coupled together, of which one is shown in FIG. 4. It consists of a U-shaped central portion 40, from which two shaft extensions 41 an 42 extend. The shaft extension 41 has a central bore 43, the length and inner diameter of which correspond to the length and outer diameter of the shaft extension 42. The shaft extension 42 of a shaft component 15*a* extends into the bore 43 in the adjacent shaft component 15*a*, so that a shaft 15 is formed in the six-cylinder example shown, which consists of six shaft components 15*a* axially fixed relative to each other but freely rotatable relative to each other.

In an alternative embodiment (not shown), the individual shaft components 15*a* are fixed on a torsion rod which can be an axially slotted pipe.

Each shaft component 15*a* has a long lateral projection forming the first pivot arm 17 and having a roller 19 journalled on a pin 19*a* and a short lateral projection forming a second pivot arm 18 with a cam surface 20. Each shaft component 15*a* is provided with a central lubricant conduit 44, so that a complete conduit is formed from one end to the other of the composite shaft 15.

FIG. 7 shows the composite shaft 15 and a control system for axial displacement of the same. The cam surfaces 20 are, for the sake of illustration, turned 90° here relative to the position in reality. The shaft 15 is biassed to the left in FIG. 7 by a spring 15 towards a limit position in which no exhaust is returned by virtue of the fact that the cam surface 20 will assume a position in which it does not reach the surface 21 of the exhaust rocker arm 4. The left-hand end of the shaft 15 forms a piston 51 in a hydraulic cylinder 52. The pressure in the cylinder 52 determines the axial setting of the shaft 15 and this pressure is regulated by the engine central control unit 53 into which rpm, load, temperature, etc, readings are fed, as indicated by the arrows 54, 55, 56. The control unit 53 controls a regulating valve 57 and is programmed with the desired exhaust recirculation value as a function of engine rpm and load, or engine temperature. The command value for the axial position is compared with the actual value from an inductive positional sensor 58 on the shaft 15 and the control unit 53 gives a signal dependent on the obtained values to the regulating valve to regulate the pressure in the cylinder 51 so that the shaft 15 is moved to a position providing the desired exhaust recycling.

The arrangement according to the invention is extremely reliable due to the fact that it uses known engine components in a known environment. No pump or throttle is required in the exhaust system. It provides a well defined mixing-in of exhaust in the intake air. The mixing-in can be varied rapidly without delay and without any substantial differences between the cylinders. Pre-programming of the engine control unit will make possible simple control of the mixing-in within the entire work range of the engine regardless of other parameters. The cost will be low compared to a conventional system with corresponding regulating capacity.

I claim:

1. Valve mechanism in an internal combustion engine, comprising at least one intake valve and at least one exhaust valve in each cylinder, and for each cylinder at least two rocker arms journalled on a rocker arm shaft for operating a respective one of said valves, characterized by transmission means (15,17,18), which is arranged to selectively move the exhaust valve (5) from a closed position toward an open position during the engine intake stroke to draw exhaust into the cylinder (30) during the intake stroke.

2. Valve mechanism according to claim 1, characterized in that the transmission means comprises means (21) for varying the opening time of the exhaust valve (5) and the valve lift thereof.

3. Valve mechanism according to claim 2, characterized in that the transmission means (15,17,18) is synchronized with the rocker means (2) of the intake valve (3), so that the set maximum valve lift of the exhaust valve (5) coincides with the maximum valve lift of the intake valve.

4. Valve mechanism according to claim 1, characterized in that the transmission means comprises elements (15,17,18) interacting with the rocker arms (2,4) of the intake valve and the exhaust valve, said elements enabling a portion of the rocking movement of the intake rocker arm (2) to be transmitted to the exhaust rocker arm (4).

5. Valve mechanism according to claim 4, characterized in that said elements comprise a second shaft (15) rotatably journalled parallel to the rocker arm shaft (1) and having first and second pivot arms (17,18), non-rotatably joined to said second shaft, the first pivot arm (17) interacts with the intake rocker arm (2) to convert its rocking movement into a rotary movement of the second shaft (15) and the second pivot arm (18) interacts with the exhaust rocker arm (4) to convert the rotary movement of the second shaft into a rocking movement of the exhaust rocker arm.

6. Valve mechanism according to claim 5, characterized in that the first pivot arm (17) at a distal end has a roller (19) in contact with a cam roller (8) on the intake rocker (2).

7. Valve mechanism according to claim 5, characterized in that the second shaft (15) is axially displaceable, that the second pivot arm (18) has a surface (20) facing a cooperating surface (21) on an end of the exhaust rocker arm (4) and that one of said surfaces (20,21) has a cam surface shaped so that the lift of the exhaust valve during the intake stroke is variable from no lift, in a predetermined axial position of the second shaft (15), to maximum lift at a certain displacement of the second shaft from said predetermined position.

8. Valve mechanism according to claim 7, characterized in that the second shaft (15) is constantly biased in a direction towards the predetermined position by a spring (50) and is displaced by pressure medium in an opposing direction, that a control unit (53) is arranged which regulates the pressure of the medium depending on values supplied to the control unit of at least engine rpm and load and of the position of the second shaft sensed by a positional sensor (58).

9. Valve mechanism according to claim 5, characterized in that the second shaft (15) in a multi-cylinder engine is divided into separate shaft components (15*a* ) for the individual cylinders, said shaft components being arranged for axial displacement, but which permit pivoting of the first and second pivot arms (17,18) for each cylinder relative to the pivot arms for the other cylinders.

* * * * *